US006799515B2

(12) United States Patent
Lynn et al.

(10) Patent No.: US 6,799,515 B2
(45) Date of Patent: Oct. 5, 2004

(54) LUMINOUS DOUBLE FACED PICTURE DISPLAY

(76) Inventors: Jerry K Lynn, 83 Strawberry Hill La., Lineville, AL (US) 36266; Willa M Lynn, 83 Strawberry Hill La., Lineville, AL (US) 36266

( * ) Notice: Subject to any disclaimer, the term of this patent is extended or adjusted under 35 U.S.C. 154(b) by 163 days.

(21) Appl. No.: 10/094,724

(22) Filed: Mar. 11, 2002

(65) Prior Publication Data

US 2003/0167947 A1 Sep. 11, 2003

(51) Int. Cl.[7] ..... G09F 15/00

(52) U.S. Cl. ..... 101/483; 40/734; 40/737; 40/716; 40/606.18

(58) Field of Search ..... 40/734, 737, 714, 40/716, 606.18, 546, 572; 101/483, 485, 494

(56) References Cited

U.S. PATENT DOCUMENTS

| | | | | | |
|---|---|---|---|---|---|
| 2,297,285 | A | * | 9/1942 | Bledsoe | 40/634 |
| 3,956,837 | A | * | 5/1976 | Itano | 40/745 |
| 4,165,572 | A | * | 8/1979 | Sussman | 40/661 |
| 4,847,663 | A | * | 7/1989 | Query | 355/70 |
| 4,965,456 | A | * | 10/1990 | Huettenrauch et al. | 250/515.1 |
| 5,537,767 | A | * | 7/1996 | Schneider et al. | 40/611.01 |
| 5,586,401 | A | * | 12/1996 | Sheehan et al. | 40/737 |
| 5,615,503 | A | * | 4/1997 | Current | 40/601 |
| 6,125,566 | A | * | 10/2000 | McLaughlin | 40/737 |
| 6,309,065 | B1 | * | 10/2001 | Marchione et al. | 351/44 |
| 6,493,976 | B2 | * | 12/2002 | Kenney | 40/661 |
| 2001/0039750 | A1 | * | 11/2001 | Venegas | 40/607 |
| 2002/0088155 | A1 | * | 7/2002 | Persson | 40/542 |

* cited by examiner

*Primary Examiner*—Andrew H. Hirshfeld
*Assistant Examiner*—Kevin D. Williams
(74) *Attorney, Agent, or Firm*—Michael I Kroll

(57) ABSTRACT

The present invention 10 discloses a process for forming a translucent first image onto a transparent media 34 and forming a translucent mirror image of the first image onto a second transparent media 36 whereupon the first image and the second mirror image are placed face to face or back to back and positioned between opposing layers 42, 44 of transparent material where application of ambient light will produce a luminous effect on the dual image. Enhancement of a part or entire images is further achieved by centrally placing a thin layer of tissue paper 46, cut into the desired shape and sized between the two layers 34, 36 of transparent media holding the images. The tissue paper 46 serves to diffuse light imparting a luminous quality to the coplanar images, in either frontal 16 or backlighting 18 conditions.

8 Claims, 12 Drawing Sheets

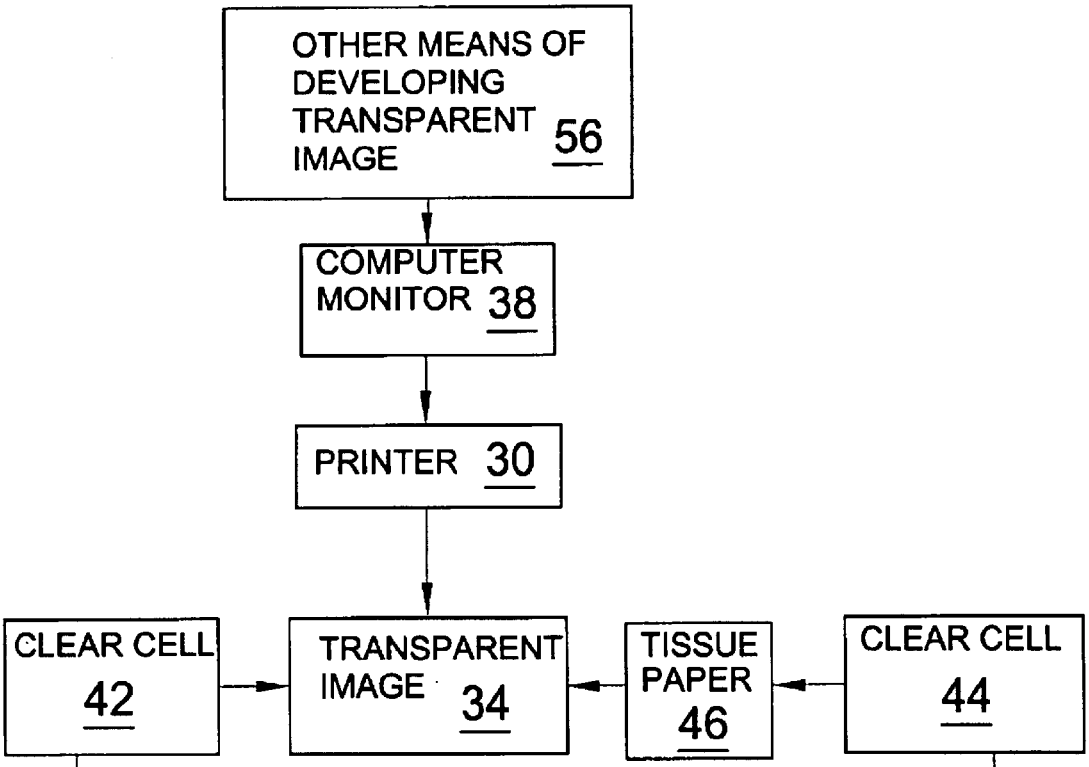
FIG. 11
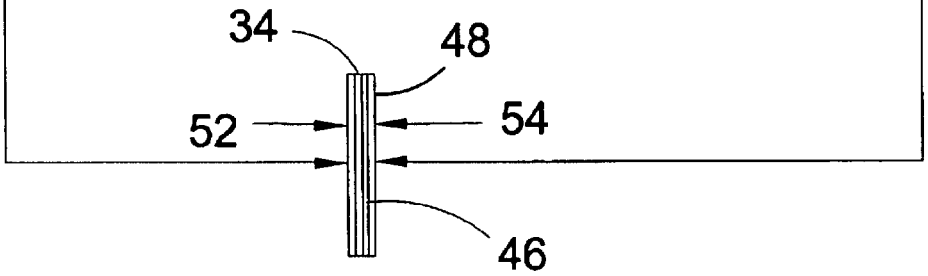

LUMINOUS DOUBLE FACED PICTURE DISPLAY

BACKGROUND OF THE INVENTION

1. Field of the Invention

The present invention relates generally to Picture displaying techniques and more specifically to a luminous, double faced picture display technique that is a process of developing a transparent photo and mirror image photo oriented on one or more transparencies, to create a pair of identical or mirror images superimposed on one or more layers of transparencies with an optional layer of translucent tissue paper sandwiched in between. The result is a doubled faced, luminous photograph.

The process of the present invention involves laminating, forming or applying a translucent first image onto a transparent media and laminating, forming or applying a translucent mirror image of the first image onto a transparent media whereupon the first image and the second mirror image are placed face to face or back to back and positioned between opposing layers of transparent material where application of ambient light will produce a luminous effect on said dual image. Enhancement of a part or entire images is further achieved by centrally placing a thin layer of tissue paper, cut into the desired shape and sized between the two layers of transparent media holding the images.

The preferred method of the present invention is to have a pair of identical mirror images superimposed on opposing layer of transparencies with a layer of translucent tissue paper sandwiched therebetween. The tissue paper serves to diffuse a light imparting a luminous quality to the coplanar images, in either frontal or back lighting conditions.

2. Description of the Prior Art

There are other picture display techniques designed for the display of pictures. Typical of these is U.S. Pat. No. 230,741 issued to Caldwell on Aug. 3, 1880.

Another patent was issued to Fischer on Aug. 23, 1910 as U.S. Pat. No. 968,459. Yet another U.S. Pat. No. 978,157 was issued to Heisterman on Dec. 13, 1910 and still yet another was issued on Feb. 21, 1922 to Sutphen as U.S. Pat. No. 1,407,498.

Another patent was issued to Glass et al. on Nov. 7, 1950 as U.S. Pat. No. 2,529,151. Yet another patent was issued to Gessler on Dec. 29, 1964 as U. S. Pat. No. 3,163,554. Another patent was issued to Blake et al on Sept. 1, 1992 as U.S. Pat. No. 5,144,328 and still yet another patent was issued to Hill on Apr. 10, 2001 as U.S. Pat. No. 6,212,805.

U.S. Pat. No. 230,741

Inventor: William Caldwell

Issued: Aug. 3, 1880

The present invention relates to a new and useful improvement in illuminated printing. A transparent or translucent card or sign having an incomplete part of its lettering or design on the face and the remaining part thereof on the back, in such manner that when held up to the light the design or lettering on the back will complete the design or lettering on the face and vice versa, substantially as specified.

U.S. Pat. No. 968,459

Inventor: Albert Fischer

Issued: Aug. 23, 1910

The present invention discloses a transparent sign consisting of letters, numerals, fanciful or practical designs of any kind or character, figures or pictures comprising the transparent portion printed upon both sides of a sheet of paper or equivalent transparent or translucent material and surrounded by a dark or opaque background.

U.S. Pat. No. 978,157

Inventor: William Heisterman

Issued: Dec. 13, 1910

The invention relates to advertising devices which will display certain announcements, designs, devices or pictures or a combination of any or all of them in such a manner that they will be visible by natural or artificial reflected light, but disappear by transmitted light and their places be taken by other announcements, designs devices or pictures which are only visible by the transmitted light.

U.S. Pat. No. 1,407,498

Inventor: Robert M. Sutphen

Issued: Feb. 21, 1922

This invention relates to the preparation of drawings of inventions and associated matters such as trade marks and designs and its object is to illustrate them more clearly or in a more life like manner.

U.S. Pat. No. 2,529,151

Inventor: Marvin Glass et al.

Issued: Nov. 7, 1950

This invention relates to a novelty photograph and the object of the invention is the provision of a novelty photo whereby two views dealing with a common subject matter may be displayed as desired so as to show alternate changes in said views.

U.S. Pat. No. 3,163,554

Inventor: Robert Gessler

Issued: Dec. 29, 1964

The present invention relates to a novel film for use in visual presentations and to the presentation of visual impressions therefrom.

U.S. Pat. No. 5,144,328

Inventor: Dale Blake et al.

Issued: Sept. 1, 1992

A method for producing a large scale color graphic that presents substantially the same spectral content to a viewer when the graphic is illuminated with front or back lighting includes applying an ink film on a first surface and a second ink film on a second surface wherein the ink film creates the desired colored graphic image and which images produced are in registry with one another. A light source located on the same side as an observer viewing the image passes light through the ink film in one direction and is reflected back through the ink in a substantially opposite direction so that light reaching the observer passes through the equivalent of two ink film thicknesses. A light source located in back of the image so that the image is between the light source and an observer passes light through the first and second ink film layers in a direction toward the observer so that the observer views light having a spectral content that passes through the equivalent of two ink film thicknesses and replicates the spectral content of light from a light source located on the same side as the observer.

U.S. Pat. No. 6,212,805

Inventor: George Hill

Issued: Apr. 10, 2001

A panel includes a sheet of light permeable, preferably optically clear transparent material and a transparent or translucent design superimposed on or forming part of a transparent or translucent base pattern. The design is visible from one side of the panel and a mirror image of the design is visible from the other side of the panel when a sufficiently high level of illuminated is provided on either side or both sides of the panel.

SUMMARY OF THE PRESENT INVENTION

The present invention discloses a process for forming or applying a translucent first image onto a transparent media and forming or applying a translucent mirror image of the first image onto a second transparent media whereupon the first image and the second mirror image are placed face to face or back to back and positioned between opposing layers of transparent material where application of ambient light will produce a luminous effect on the dual image. Enhancement of a part or entire images is further achieved by centrally placing a thin layer of tissue paper, cut into the desired shape and sized between the two layers of transparent media holding the images. The preferred method of the present invention is to have a pair of identical mirror images superimposed on opposing layer of transparencies with a layer of translucent tissue paper sandwiched therebetween. The tissue paper serves to diffuse light imparting a luminous quality to the coplanar images, in either frontal or back lighting conditions.

A primary object of the present invention is to provide a luminous, double faced picture display.

Another object of the present invention is to provide a luminous, double faced picture display having a first image printed using translucent ink on a front side of a transparency and a second mirror image printed using translucent ink on the back side of said transparency in registration with said first image.

Another object of the present invention is to provide a luminous, double faced picture display having a first image printed using translucent ink on a first transparency and a second mirror image printed on a second transparency. With said images placed in registration with one another.

Another object of the present invention is to provide a luminous, double faced picture display having a first image printed using translucent ink on a first transparency and a second mirror image printed on a second transparency. With said images placed on opposing sides of a diffuser material and in registration with one another.

Yet another object of the present invention is to provide a luminous, double faced picture display technique that is a process of developing a transparent photo and a mirror image photo oriented on one or more transparencies with an optional layer of translucent tissue paper sandwiched in between with the result of producing a double faced luminous photograph.

A still further object of the present invention is that the diffusion layer also serves to enhance the picture in frontal lighting conditions.

Additional objects of the present invention will appear as the description proceeds.

The present invention overcomes the shortcomings of the prior art by providing a system for producing a luminous image display comprised of generating a first transparency having a translucent ink image and a second translucent ink mirror image positioned on the other side of said transparency in registration with said first image.

Additionally the present invention provides a system for producing a luminous image display comprised of generating a first transparency having a translucent ink image and a second transparency having a translucent ink mirror image with a light diffusing material such as translucent tissue paper positioned between said transparencies with said images being in registration with one another.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

BRIEF DESCRIPTION OF THE DRAWINGS

FIG. 11 is a flow chart of the process of the present invention.

LIST OF REFERENCE NUMERALS

Figure 1:
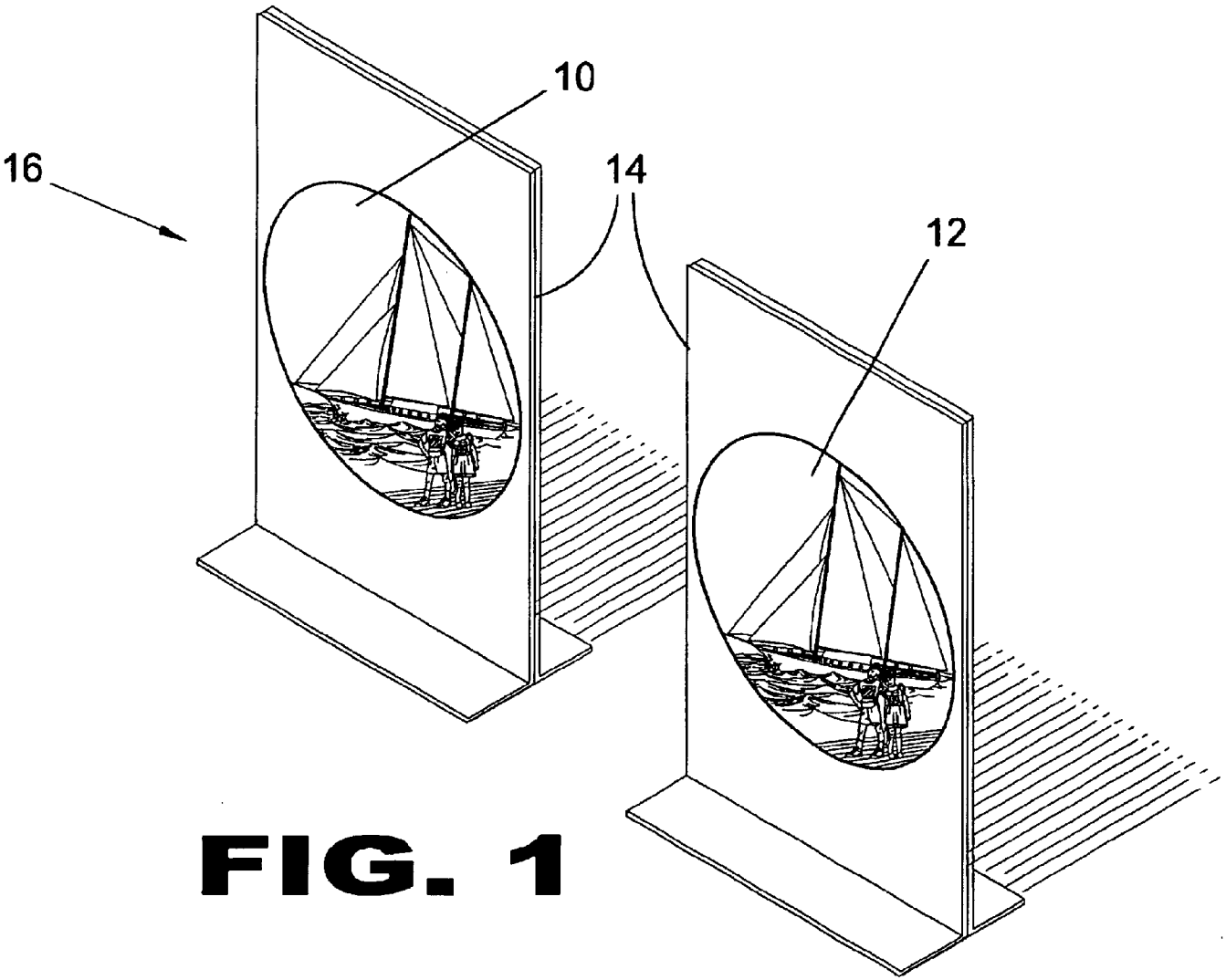
FIG. 1 illustrative view of the present invention and a conventional picture in a frontlit condition.

With regard to reference numerals used, the following numbering is used throughout the drawings.

| | |
|---|---|
| 10 | present invention |
| 12 | conventional picture |
| 14 | picture frame |
| 16 | front light source |
| 18 | back light source |
| 20 | shadow |
| 24 | user |
| 26 | computer system |
| 28 | scanner |
| 30 | printer |
| 32 | transparent media |
| 34 | first transparent picture |
| 36 | second transparent picture mirror image |
| 38 | monitor |
| 40 | photograph |
| 42 | first transparent material |
| 44 | second transparent material |
| 46 | tissue paper |
| 48 | assembled present invention |
| 48 | software program |
| 50 | software program |
| 52 | front side |
| 54 | back side |
| 56 | opaque border |
| 58 | light passing through |
| 60 | no light passing through |

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is a perspective view of the present invention 10 alongside a conventional photograph 12 in a front-lit 16 condition. The luminous picture 10 is on the left and a conventional picture 12 is on the right with both pictures in identical clear acrylic frames 14 for demonstrative purposes with frontal lighting source 16 and similar visibility.

Figure 2:
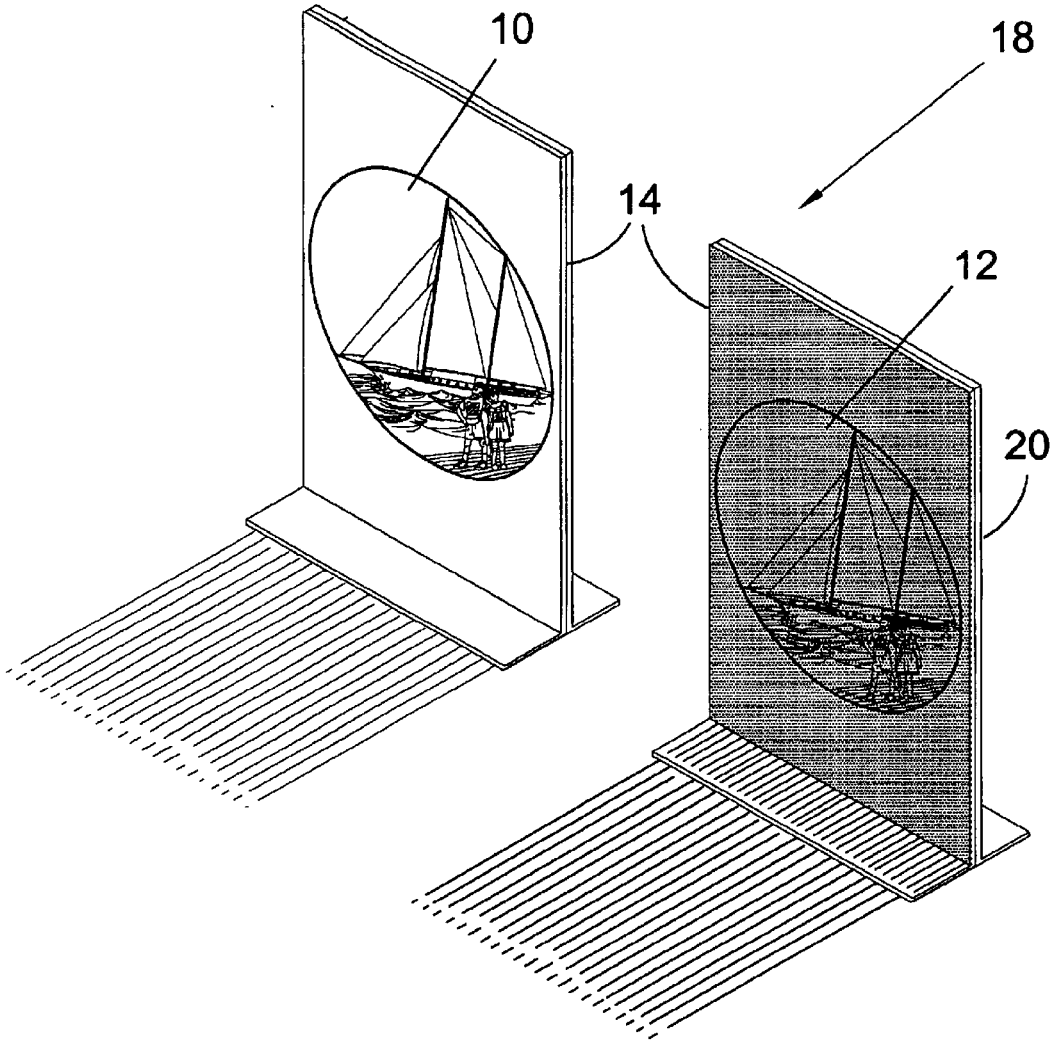
FIG. 2 illustrative view of the present invention and a conventional picture in a backlit condition.

Turning to FIG. 2, shown therein is a perspective view of the present invention 10 alongside a conventional photograph 12 in a backlit 18 condition. The luminous picture 10 is on the left and a conventional picture 12 is on the right with both pictures in identical clear acrylic frames 14 with backlighting source 18 casting the face of the conventional picture 12 in shadows 20 while illuminating the luminous picture 10 on the left.

Figure 3:
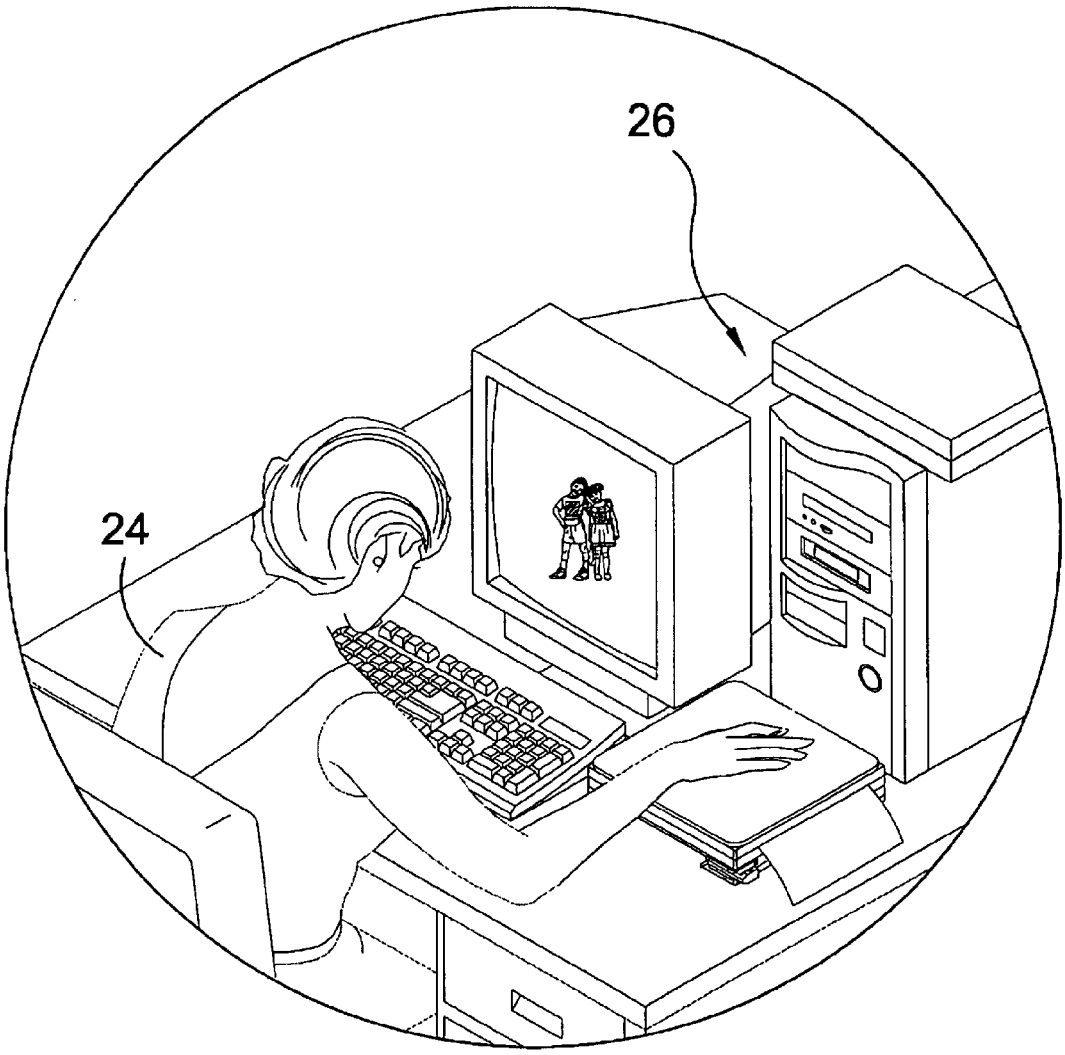
FIG. 3 is an illustrative view of the process of the present invention.

Turning to FIG. 3, shown therein is an illustrative view of the process of the present invention with a user 24 and a computer system 26. In summary, the present invention, a luminous, double faced picture display technique is a process of developing a transparent photo and a mirror image photo oriented on one or more transparencies, to create a pair of identical or mirror images superimposed on one or more layers of transparency media with an optional layer of translucent tissue paper sandwiched in between. The result is a double faced, luminous photograph.

Figure 4:
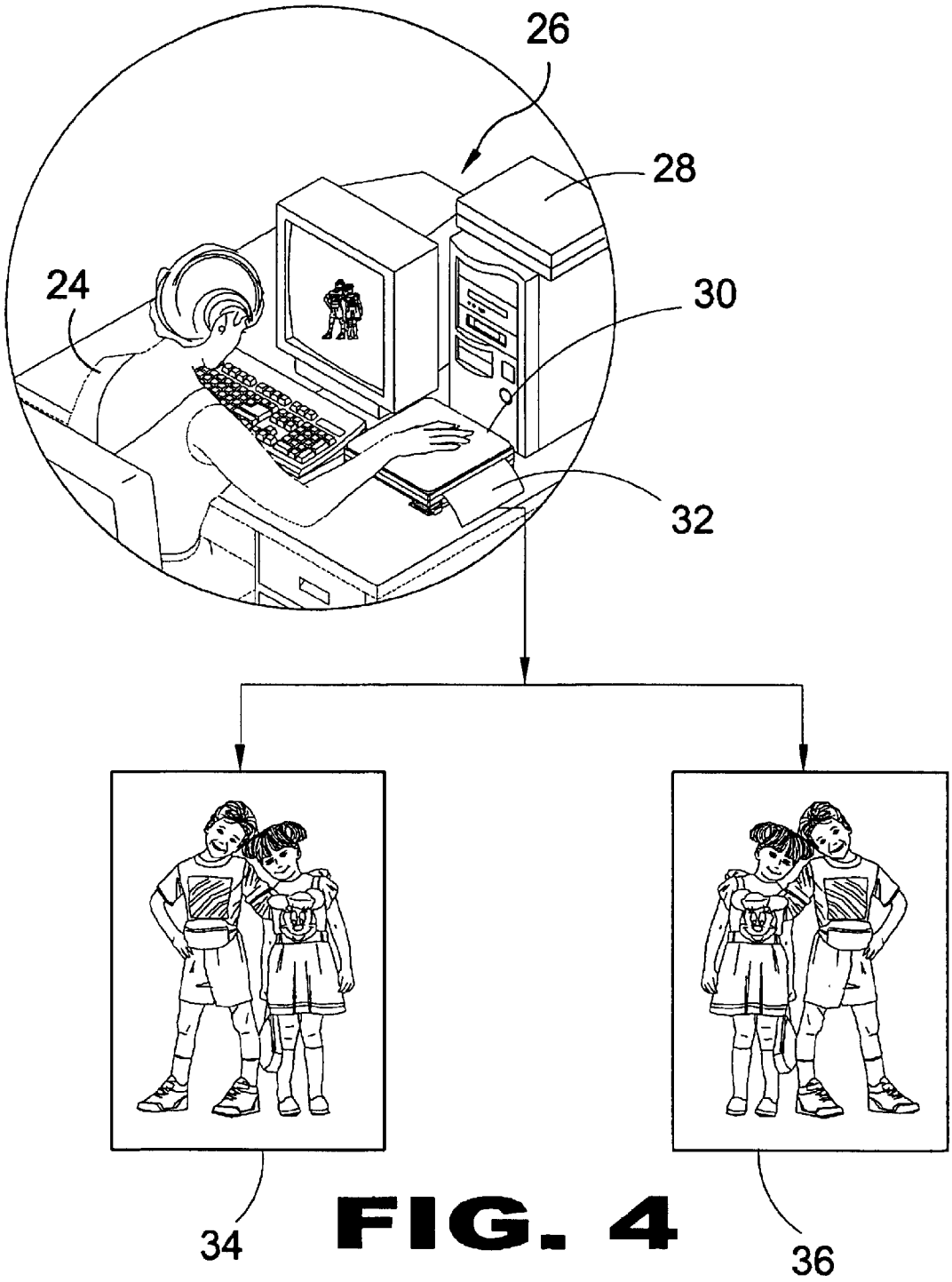
FIG. 4 is a flow chart of one process of the present invention.

Turning to FIG. 4, shown therein is a flow chart of one process of the present invention with user 24 and computer system 26 having a scanner 28 and a printer 30. The process of the present invention involves forming or applying, e.g. by printing, a translucent first image onto a transparent media 32 to yield a first transparent image or picture 34 and forming or applying a translucent mirror image of the first image onto a second transparent media to yield a second transparent image or picture mirror image 36 whereupon the first image and the second mirror image are placed face to face or back to back and positioned between opposing layers of clear, transparent material where application of ambient light will produce a luminous effect on the dual image. Enhancement of a part or entire images is further achieved by centrally placing a thin layer of tissue paper, cut into the desired shape and size between the two layers of transparent media holding the images to form the assembled present invention.

Figure 5:
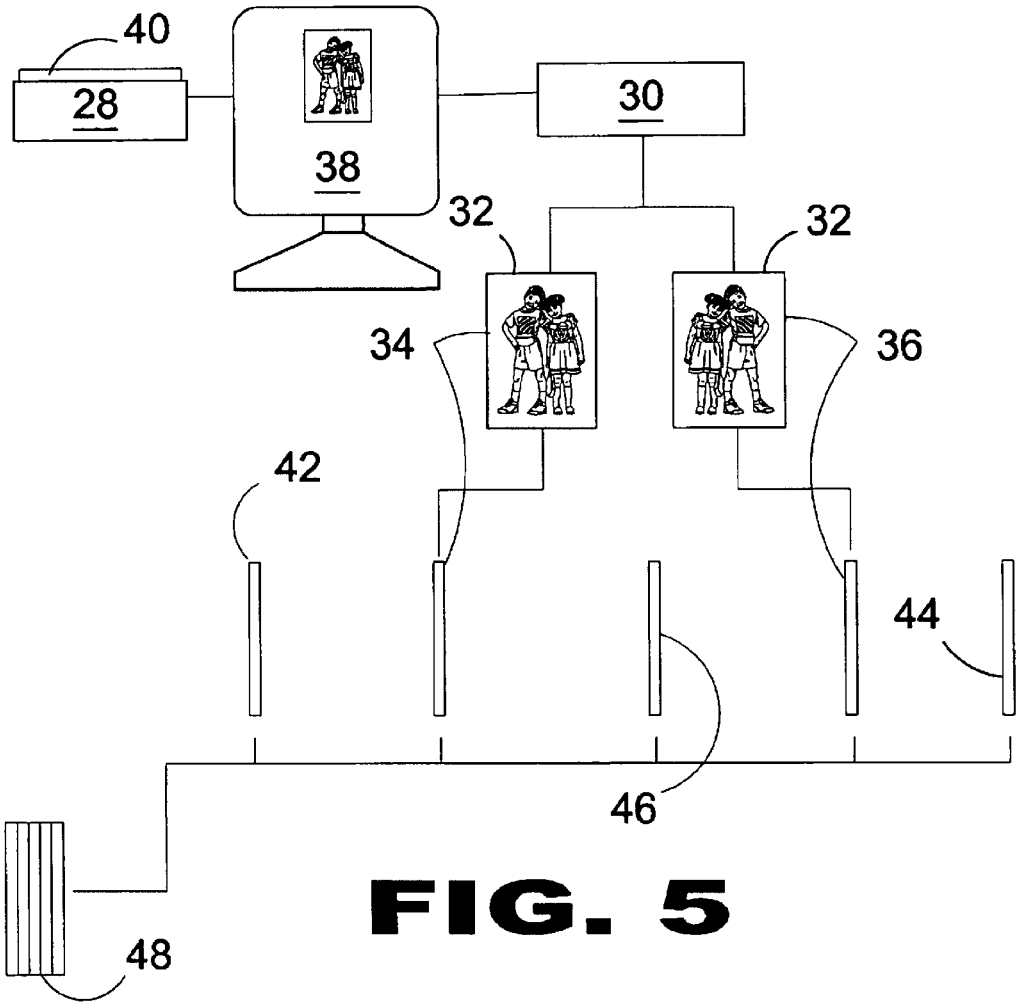
FIG. 5 is a flow chart of the process of the present invention.

Turning to FIG. 5, shown therein is a flow chart of the process of the present invention. Shown is a computer monitor 38 with a photograph 40 on the scanner 28 and printer 30. The process of the present invention involves forming or applying a translucent first image onto a transparent media 32 to yield a first transparent picture 34 and forming or applying a translucent mirror image of the first image onto a second transparent media to yield a second transparent picture mirror image 36 whereupon the first image and the second mirror image are placed face to face or back to back and positioned between opposing layers of clear, transparent material 42, 44 where application of ambient light will produce a luminous effect on the dual images. Enhancement of a part or entire images is further achieved by centrally placing a thin layer of tissue paper 46, cut into the desired shape and size between the two layers of transparent media 32 holding the images 34, 36 to form the assembled present invention 48. In summary, the preferred method of the present invention is to have a pair of identical mirror images superimposed on opposing layers of transparencies 34, 36 with a layer of translucent tissue paper 46 sandwiched therebetween. The tissue paper 46 serves to diffuse light imparting a luminous quality to the coplanar images at 34, 36.

Figure 6:
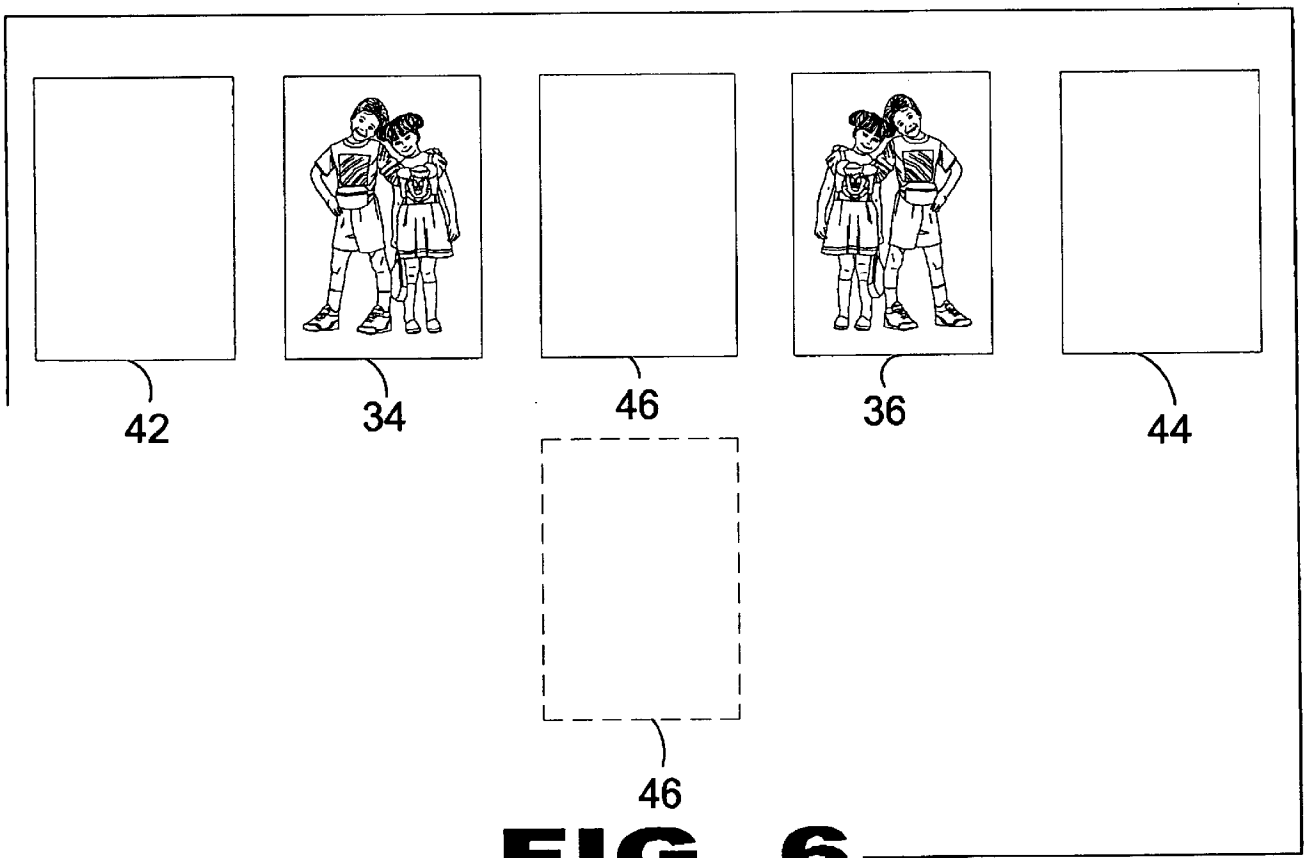
FIG. 6 is an illustrative view of the process of the present invention.

Turning to FIG. 6, shown therein is an illustrative view of the process of the present invention. If further enhancement to the image on layers 34, 36 or part thereof is desired, a thin sheet of tissue paper 46, which may be white, may be sandwiched in between the mirror images 34, 36. This effect makes it appear luminous and bright as if it had its own light source. Clear layers 42, 44 are also shown.

Figure 7:
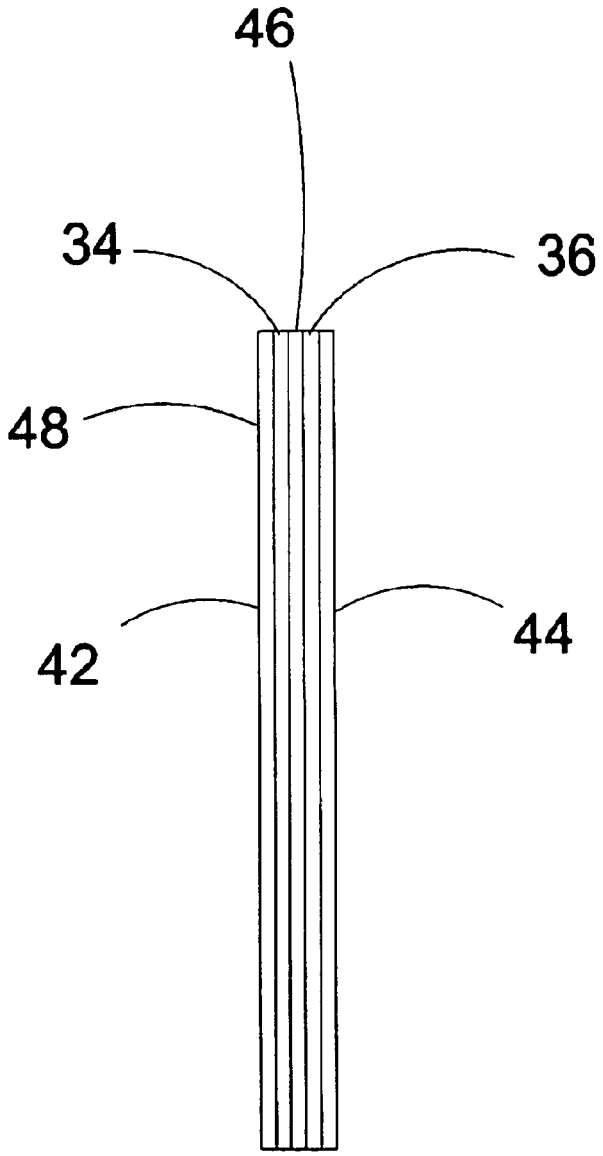
FIG. 7 is an assembled side view of the preferred embodiment of the present invention.

Turning to FIG. 7, shown therein is an assembled side view of the preferred embodiment of the present invention 48. The process of the present invention involves a transparent image printed on transparent film 34 and a mirror image print of the same properties 36. Both sheets of transparencies 34, 36 are placed between two layers 42, 44 of clear acrylic, lead glass or laminating material in such a way, that the mirror images are exactly superimposed on each other. This creates a double faced effect and the images appear luminous with back lighting. A layer of thin tissue paper 46 is placed between layers 34, 36.

Figure 8:
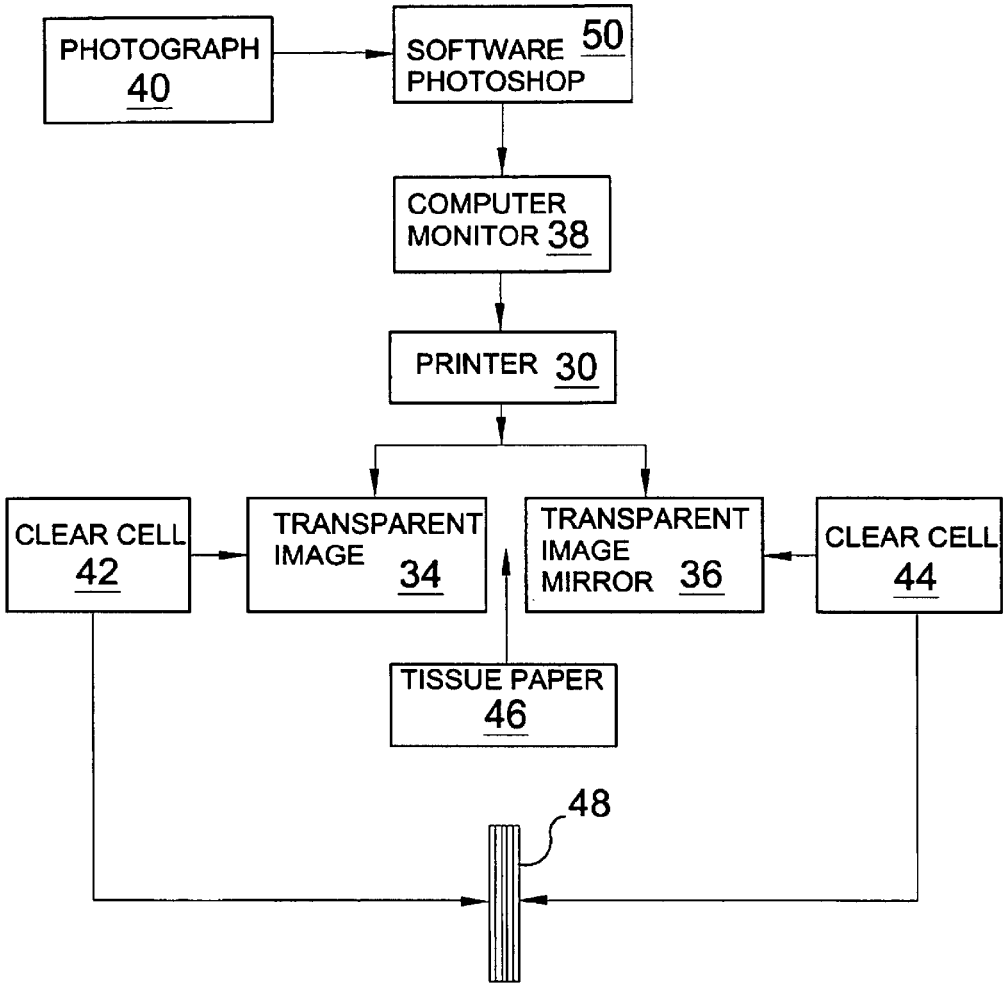
FIG. 8 is a flow chart of the process of the present invention.

Turning to FIG. 8, shown therein is a flow chart of the process of the present invention. Shown is a flow chart of the process of creating an assembled transparency picture display 48 using a software program 50 such as PHOTOSHOP. Other elements previously disclosed are shown.

Figure 9:
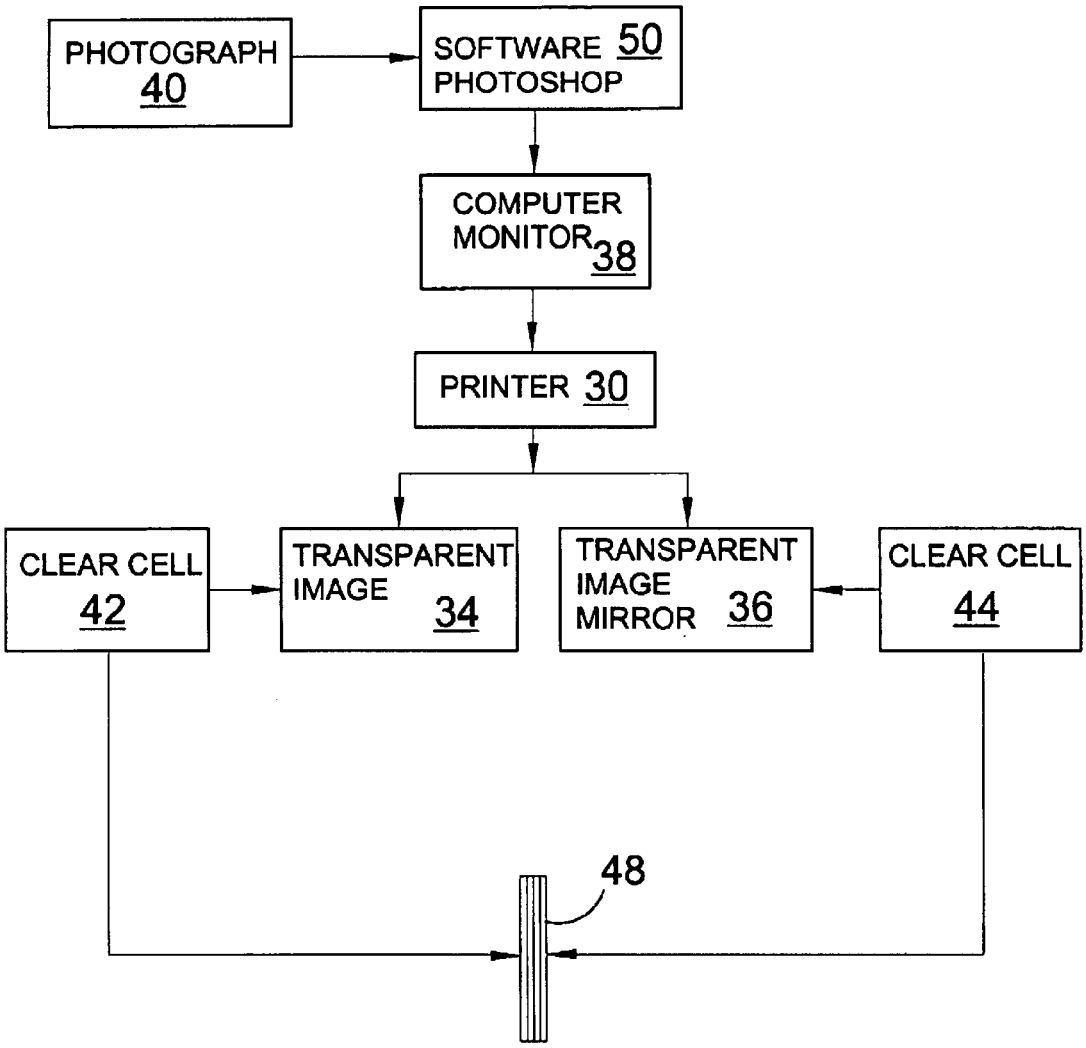
FIG. 9 is a flow chart of the process of the present invention.

Turning to FIG. 9, shown therein is a flow chart of the process of the present invention. Shown is a flow chart of the process of creating a transparency picture display without the use of a diffuser material 46, e.g. tissue paper. Other elements previously disclosed are shown.

Figure 10:
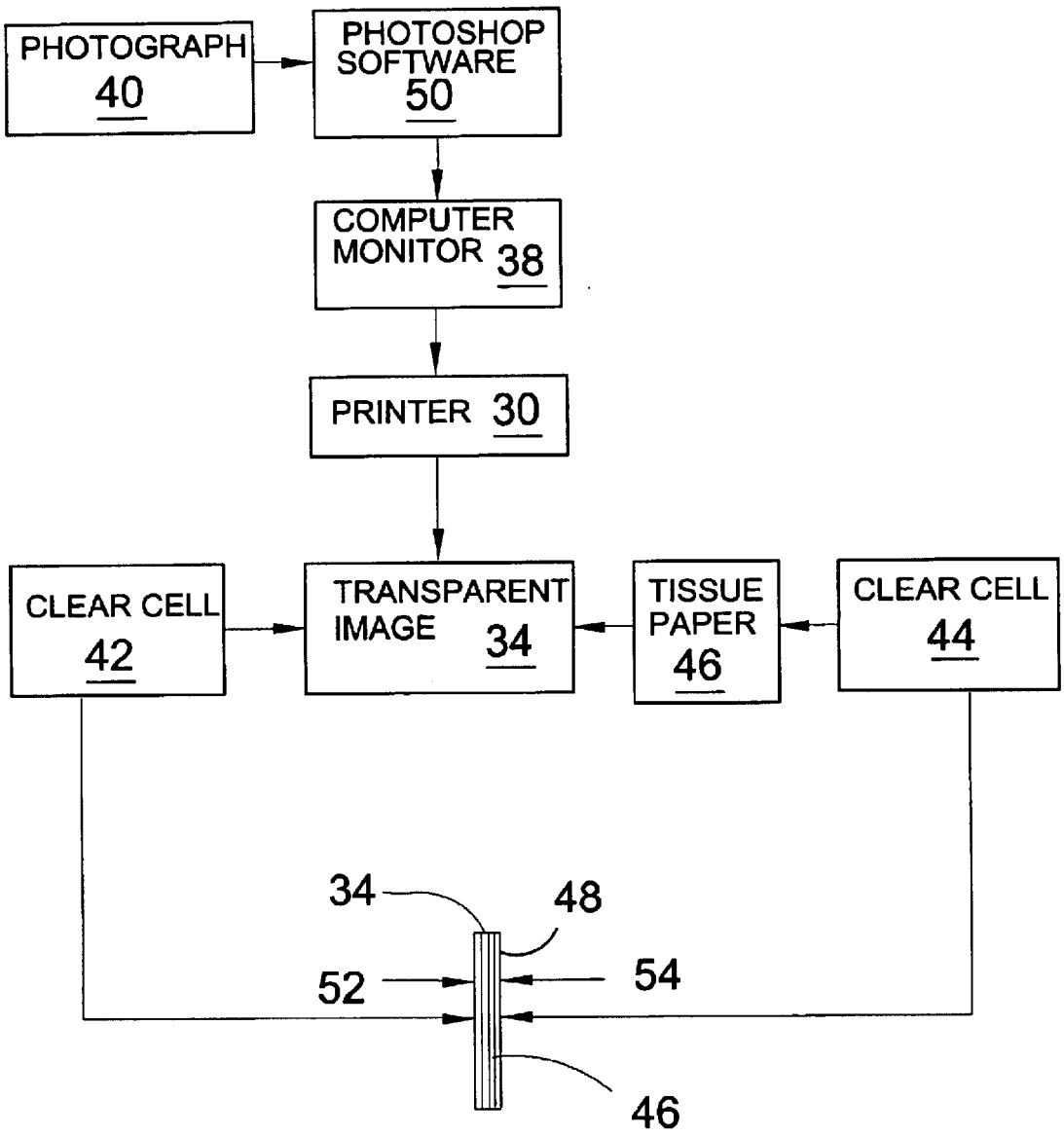
FIG. 10 is a flow chart of the process of the present invention

Turning to FIG. 10, shown therein is a flow chart of the process of the present invention. Shown is a flow chart of the process of creating a transparency picture display 48 with the use of diffuser material 46 and using one transparent image 34. Shown are a single layer 34 in front 52 of diffuser material 46 which material 46 is disposed on the backside 54 of layer 34. Other elements previously disclosed are shown.

Turning to FIG. 11, shown therein is a flow chart of the process of the present invention. Shown is a flow chart showing other means 56 or another process of creating a transparency image for use with a picture display for a single faced picture 34. Shown is a flow chart of the process of creating a transparency picture display 48 with the use of diffuser material 46 and using one transparent image 34. Shown are a single layer 34 in front 52 of diffuser material 46 which material 46 is disposed on the backside 54 of layer 34. Other elements previously disclosed are shown.

Figure 12:
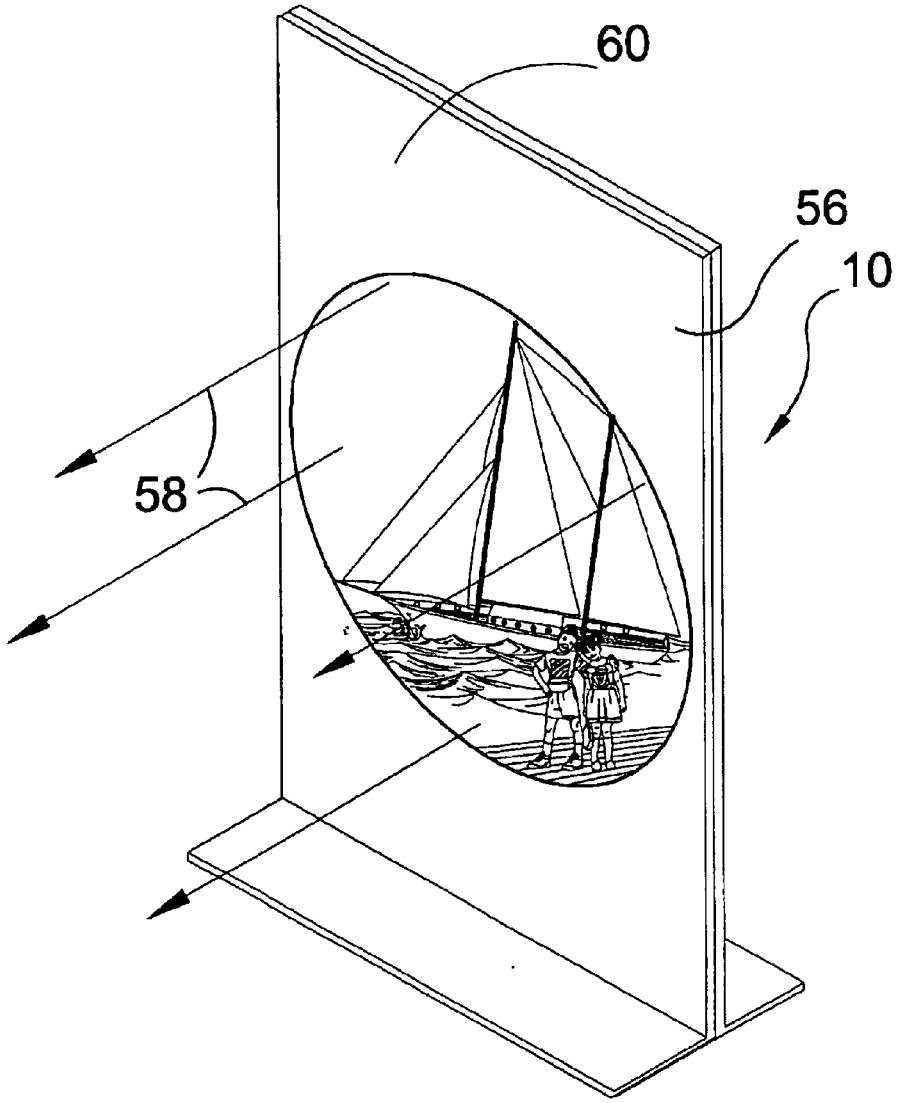
FIG. 12 is an illustrated view of a transparency of the present invention within an opaque border.

Turning to FIG. 12, shown therein is an illustrated view of a transparency of the present invention 10 within an opaque border 56. Shown is a dual image display of the present invention 10 where ambient light passes through the transparent material at 58 and translucent images giving the images a luminous property but no back light passes through at 60.

I claim:

1. A process for forming a luminous double faced picture display, comprising the steps of:

a) forming a first image onto a first piece of transparent media;

b) forming a second mirror image of the first image onto a second piece of transparent media;

c) superimposing the first image and the second minor image onto each other back to back;

d) placing a first piece of transparent material onto the front side of the superimposed images;

e) placing a second piece of transparent material onto the back side of the superimposed images to form the completed display; and f) placing a diffuser material between the superimposed images so that light passing therethrough is diffused.

2. A process for forming a luminous double faced picture display, comprising the steps of:

a) forming a first image onto a first piece of transparent media;

b) forming a second mirror image of the first image onto a second piece of transparent media;

c) superimposing the first image and the second mirror image onto each other front to front;

d) placing a first piece of transparent material onto the front side of the superimposed images;

e) placing a second piece of transparent material onto the back side of the superimposed images to form the completed display; and f) placing a diffuser material between the superimposed images so that light passing therethrough is diffused.

3. The process of claim 2, wherein the first and second pieces of transparent material are acrylic.

4. The process of claim 2, wherein the first and second pieces of transparent material are lead glass.

5. The process of claim 2, wherein the diffuser material is tissue paper.

6. The process of claim 2, wherein the diffuser material is white.

7. The process of claim 2, further comprising the step of placing the display in a clear acrylic frame to permit back light to pass therethrough.

8. The process of claim 2, further comprising the step of placing the display in an opaque flame to prohibit back light to pass therethrough.

* * * * *